United States Patent [19]

Okazaki

[11] 4,014,064

[45] Mar. 29, 1977

[54] HAIRBRUSH

[76] Inventor: Kenichi Okazaki, 3-2-, 2-chome, Higashi-honmachi, Yaoshi, Osaka, Japan

[22] Filed: May 9, 1975

[21] Appl. No.: 576,048

Related U.S. Application Data

[63] Continuation-in-part of Ser. No. 486,410, July 8, 1974, abandoned.

[52] U.S. Cl. ..... 15/159 A; 15/195; 15/DIG. 5; 300/21

[51] Int. Cl.[2] ..... A46B 3/16

[58] Field of Search ..... 300/21; 15/159, 159 A, 15/DIG. 5, DIG. 6, 186, 187, 188, 191–197

[56] References Cited

UNITED STATES PATENTS

| | | | |
|---|---|---|---|
| 1,465,919 | 8/1923 | Benson et al. | 15/186 |
| 1,957,363 | 5/1934 | Snell | 15/191 R |
| 3,727,260 | 4/1973 | Spydevold | 15/159 A |

FOREIGN PATENTS OR APPLICATIONS

| | | | |
|---|---|---|---|
| 668,611 | 7/1929 | France | 15/159 A |
| 120,341 | 11/1918 | United Kingdom | 15/186 |

*Primary Examiner*—Peter Feldman
*Attorney, Agent, or Firm*—George B. Oujevolk

[57] ABSTRACT

A hairbrush more effective for hairbrushing and less injurious to the head skin compared to conventional hairbrushes. This hairbrush has a plurality of tufts of bristles evenly and orderly distributed over the face portion thereof, said tufts each consisting of bristles of three different lengths, said bristles being divided in three rows in a manner that the longest bristles account for the largest numerical portion of the tuft of bristles and the smaller sizes are of a correspondingly lesser amount in accordance with a predetermined proportion. This arrangement thereby makes it possible to obtain the hairbrushing effect described.

1 Claim, 3 Drawing Figures

HAIRBRUSH

CROSS-REFERENCE TO EARLIER FILED APPLICATION

This application is a continuation-in-part of U.S. patent application Ser. No. 486,410, filed July 8, 1974 now abandoned.

BACKGROUND OF THE INVENTION

The present invention relates to a hairbrush and more particularly to a hairbrush designed to be more effective for hairbrushing and less injurious to the head skin as compared with conventional hairbrushes. The hairbrush herein contemplated has a plurality of tufts of bristles orderly and evenly distributed over the face portion thereof, said tufts each consisting of bristles of three different lengths, said bristles being divided in three rows accordingly, the longest bristles accounting for the largest numerical portion of said tuft and the smaller sizes are of a correspondingly lesser amount in accordance with a predetermined proportion. This arrangement makes it possible to obtain the properties described.

BRIEF DESCRIPTION OF THE PROBLEM

It may rather be a common knowledge today that a hairbruch comprising evenly edged bristles has less hairbrushing effect because it is difficult for such a mass of bristles to penetrate into the hair body or to reach the hair root unless the bristles have the property of excessive stiffness that may cause damage to the head skin.

I assume, therefore, there may be some improved hairbrushes provided with bristles of different lengths but they may be defective still in that longer bristles are prone to buckle before reaching the hair root while shorter bristles tangle with the hair, or otherwise the shorter bristles that should be physically stiffer than the longer bristles directly scrub the head skin thereby causing damage to the head skin.

SUMMARY OF THE INVENTION

The object of this invention, therefore, is to provide a hairbrush for obviating defects of conventional hairbrushes mentioned above, said object being accomplished by orderly arranging tufts of bristles on the brush body in such a manner that each of said tufts consists of bristles of three different lengths, the longest bristles accounting for the largest numerical portion of bristles and so on as hereinbefore described.

In order that this invention may be readily understood, preferred embodiment of this invention is herein described in relation to the annexed drawing in which:

DETAILED DESCRIPTION

Figure 1:
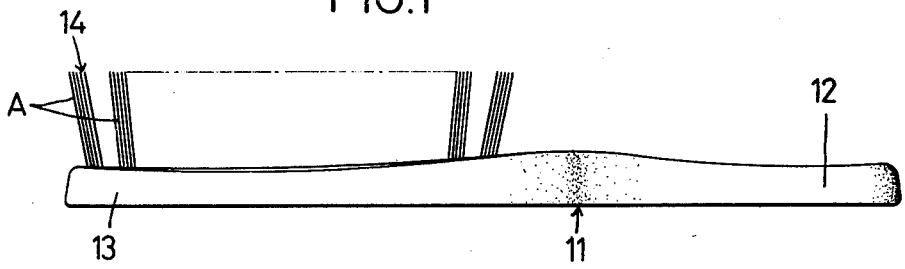
FIG. 1 is a longitudinal view of a hairbrush according to this invention.
Figure 2:
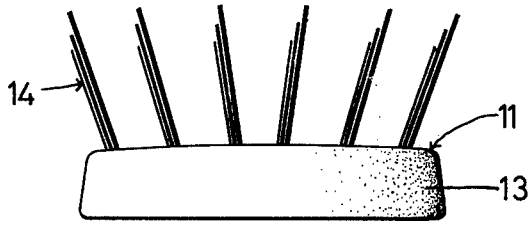
FIG. 2 is a side view in magnified scale of the above.
Figure 3:
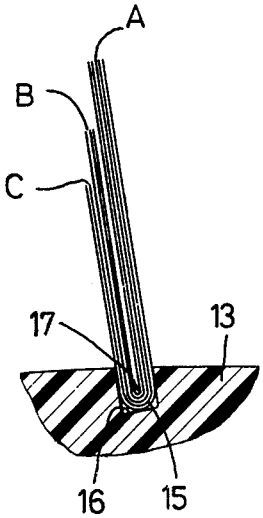
FIG. 3 is a sectional view of an important part in magnified scale of the above.

In this drawing, numeral 11 designates the hairbrush comprising a holding portion 12, a brush face 13, and bristles 14 made of synthetic resin, said bristles 14 being divided in three rows according to length from the longest to the shortest in the alphabetical order of A, B, C as shown in FIG. 3.

In FIG. 3, numerals 15 and 16 designate bristle material in the state or time before the bristles are fixed to the brush, the longer material 15 being larger in number than the shorter 16 according to a predetermined proportion.

The bristle material 15 and 16 is put together by getting one end aligned and then bending intermediately at a point a little below the middle of the longer material 15 in the position that the longer material 15 holds the inside position so as to form a tuft of bristles erect and upright from the bent portion in three rows of three different lengths designated by A, B, C. In the order of length, the longest row A accounting for the largest numerical portion of bristles constituting a tuft and the same applying correspondingly to the following rows B and C according to a predetermined proportion.

The tuft of bristles in this state is fastened to the brush face 13 at the bent portion thereof by a pin 17. The tuft is fastened to the inside thereof preferably holding the three-stepped bristles in a position to slant leftwards or rightwards against the longitudinal direction of the brush main body and also preferably providing a suitable slant to the tuft against the brush face in the level-lowering direction. Thus, the mass of all tufts are arranged on the brush body in the same manner preferably keeping a suitable and even space between each tuft.

The bristles in this invention are preferably made of synthetic resin so as to be neither too soft nor too stiff.

Using the hairbrush of this invention makes it possible to work the scalp in the most desirable manner so that the longest bristles A may provide a suitable scrubbing on the head skin and hair roots so as to stimulate blood circulation while the shorter bristles B and C effectively brush the hair body simultaneously playing the role of bracers, which is not required for the longer bristles.

I claim:

1. A hairbrush comprising a main body having a face portion, a plurality of tufts of bristles, each of said tufts comprising synthetic resin bristles of two lengths, the longer length being greater in number than the shorter length, each of said resin bristles being bent at a point other than the mid-point of the bristle, to form a long portion and a short portion, wherein the long portions of each bristle are equal, said bristles being affixed to said face portion at the bend portion of the bristle, so that the ends of said bristles are at three different heights, or steps, from the face portion of the main body, the middle height bristle being proportionely lesser in number than the highest bristle, and the shortest height bristle being proportionately lesser in number than the middle height bristle, the corresponding three steps of each tuft being equal in height.

* * * * *